United States Patent [19]

Friedman et al.

[11] Patent Number: 4,844,229

[45] Date of Patent: Jul. 4, 1989

[54] PRICE MECHANISM FOR COIN OPERATED VENDING MACHINE

[75] Inventors: Evelyn Friedman; William R. Carswell, both of Whitehall, N.Y.

[73] Assignee: EB Metal Industries, Inc., Whitehall, N.Y.

[21] Appl. No.: 162,602

[22] Filed: Mar. 1, 1988

[51] Int. Cl.[4] ..... G07F 5/08

[52] U.S. Cl. ..... 194/226; 194/227

[58] Field of Search ..... 194/226, 227, 223

[56] References Cited

U.S. PATENT DOCUMENTS

| | | | |
|---|---|---|---|
| 871,824 | 11/1907 | Rule . | |
| 2,993,581 | 7/1961 | Holstein et al. | 194/57 |
| 3,139,167 | 6/1964 | Wittern | 194/1 |
| 3,149,709 | 9/1964 | Schuller | 194/227. |
| 3,300,014 | 1/1967 | Schendorf et al. | 194/1 |
| 3,545,586 | 12/1970 | Wittern | 194/2 |
| 3,797,626 | 3/1974 | Albright | 194/2 |
| 4,421,219 | 12/1983 | Christian | 194/1 L |
| 4,592,461 | 6/1986 | Friedman et al. | 194/227 |

*Primary Examiner*—F. J. Bartuska

*Attorney, Agent, or Firm*—Dann, Dorfman, Herrell and Skillman

[57] ABSTRACT

A coin operated vending machine is disclosed having a mechanism for setting at least three prices at which an article is to be vended. Price selection is remotely effected by an externally accessible lock. A totalizer sums the inserted coins and in response to the insertion of the required amount permits the opening of the vending door. An important feature resides in the provision of a lock by which any one of the prices can be selected.

11 Claims, 5 Drawing Sheets

PRICE MECHANISM FOR COIN OPERATED VENDING MACHINE

BACKGROUND OF THE INVENTION

The present invention relates to vending machines which dispense a commodity upon insertion of a predetermined amount in coins into a coin slot in the machine. More particularly, the invention relates to a mechanism for setting the price at which the commodity is to be sold.

Of the many coin operated vending machines presently known, some employ a mechanism for setting one of two prices at which the vended article is to be sold. One such device is shown in U.S. Pat. No. 4,592,461, granted June 3, 1986 to Friedman et al. Another dual price setting mechanism is shown in U.S. Pat. No. 4,421,219, granted Dec. 20, 1983 to Christian. Friedman et al., U.S. patent application Ser. No. 838,526, filed Mar. 11, 1986, now U.S. Pat. No. 4,747,478 copending with the present application, also discloses a mechanism for setting one of two prices for the vended commodity.

There has been a need for a vending machine in which the price of the commodity can be set to at least three different prices. A further problem to which the present invention is directed is the situation where the changeover from a lower price to a higher price is neglected to be made. It is highly desirable that the vending control mechanism still deliver the commodity at the desired higher price so that customers who deposit the correct amount of coinage are not denied a vend.

SUMMARY OF THE INVENTION

The foregoing problems are solved, in accordance with the present invention, by providing in a vending machine a vending control mechanism including apparatus for setting the minimum price at which an article is to be vended. The apparatus includes any suitable totalizer adjustable to respond to the insertion of at least three different preset coin totals or prices. Preferably a totalizer, as disclosed in said application Ser. No. 838,526 is present having at least three cams which are movable from a starting position to a predetermined position when coins totaling the desired price are inserted in the vending machine. Each cam has a projection extending therefrom. Feeler means is provided for engaging each cam projection when it is in its predetermined position. The feeler means is also operatively connected to the vending door latch.

A price change plunger is operatively connected to the feeler for selectively aligning the feeler with the three cams. Means, preferably operable from outside the vending machine, are provided for remotely displacing the price change plunger to a first position corresponding to a first vending price, to a second position corresponding to a second vending price, or to a third position corresponding to a third vending price. Accordingly, the vending price in such a vending control mechanism can be set to any one of three different prices. In a further embodiment the feeler includes a lateral extension which permits the vending door latch to be released if the amount deposited in the vending machine is higher than the set price. Thus, if a price changeover to a higher price is not made, then a customer depositing the true price will still obtain a vend.

While the present invention is being described in connection with a mechanical arrangement for selecting any one of three preset prices, it is to be understood that electrical or electronic means are contemplated and can be used and substituted for the mechanical means. It is also contemplated that the apparatus can be readily modified in accordance with the present invention so as to provide selection of any one of four or more preset prices.

A further important feature of the present invention resides in the lock means which, as shown herein, can be set by means of its key in any one of three positions and left therein upon removal of the key. It is also contemplated that the lock means can be readily adapted in accordance with the present invention to be set by its key in four or more positions, the number being limited only by the maximum size of the lock that can be used in the apparatus.

DETAILED DESCRIPTION OF THE INVENTION

Figure 2:
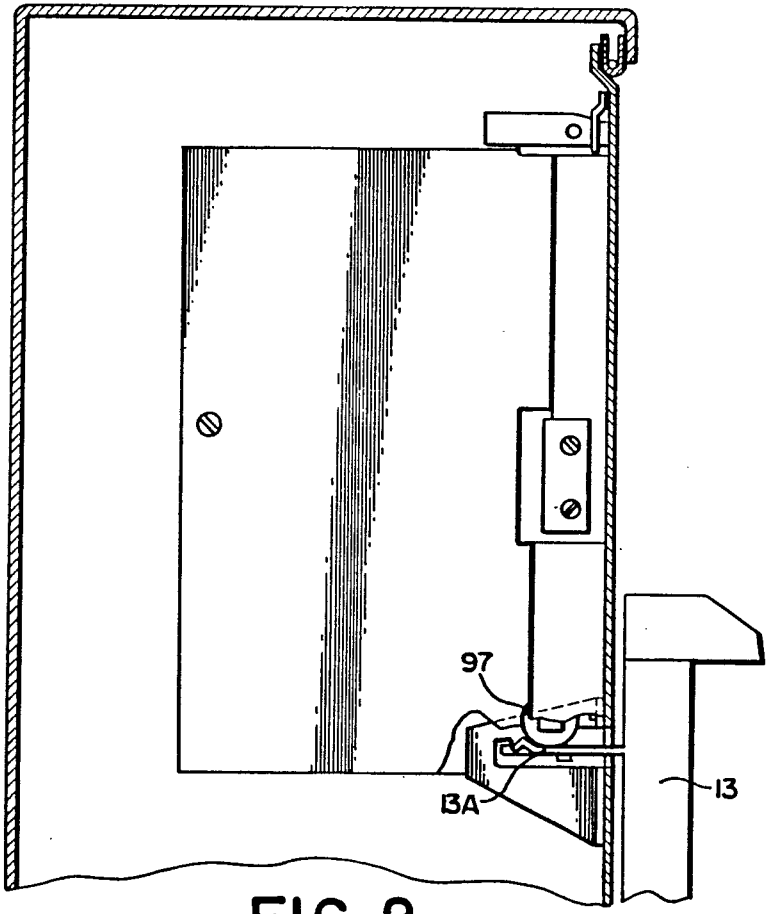
FIG. 2 is a section view along line 2—2 in FIG. 1.
Figure 1:
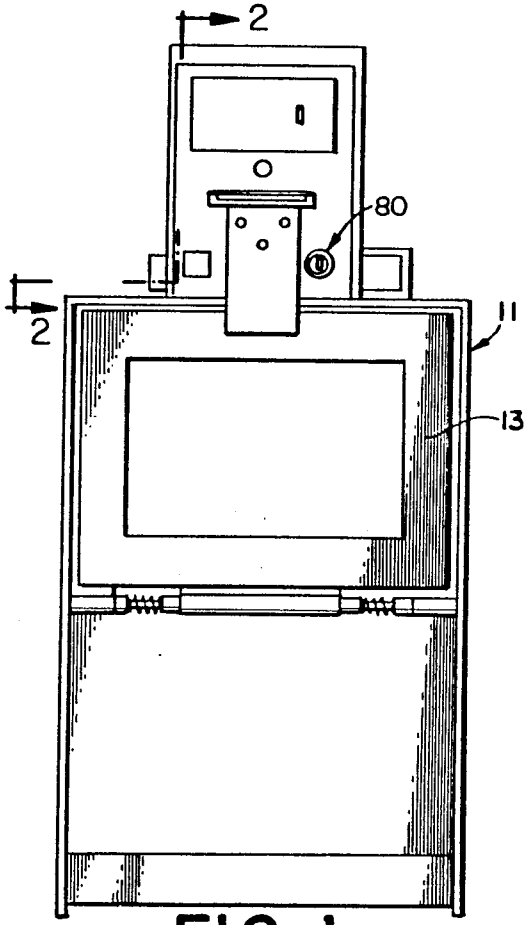
FIG. 1 is a front elevation view of a vending machine in accordance with the invention.
Figure 3:
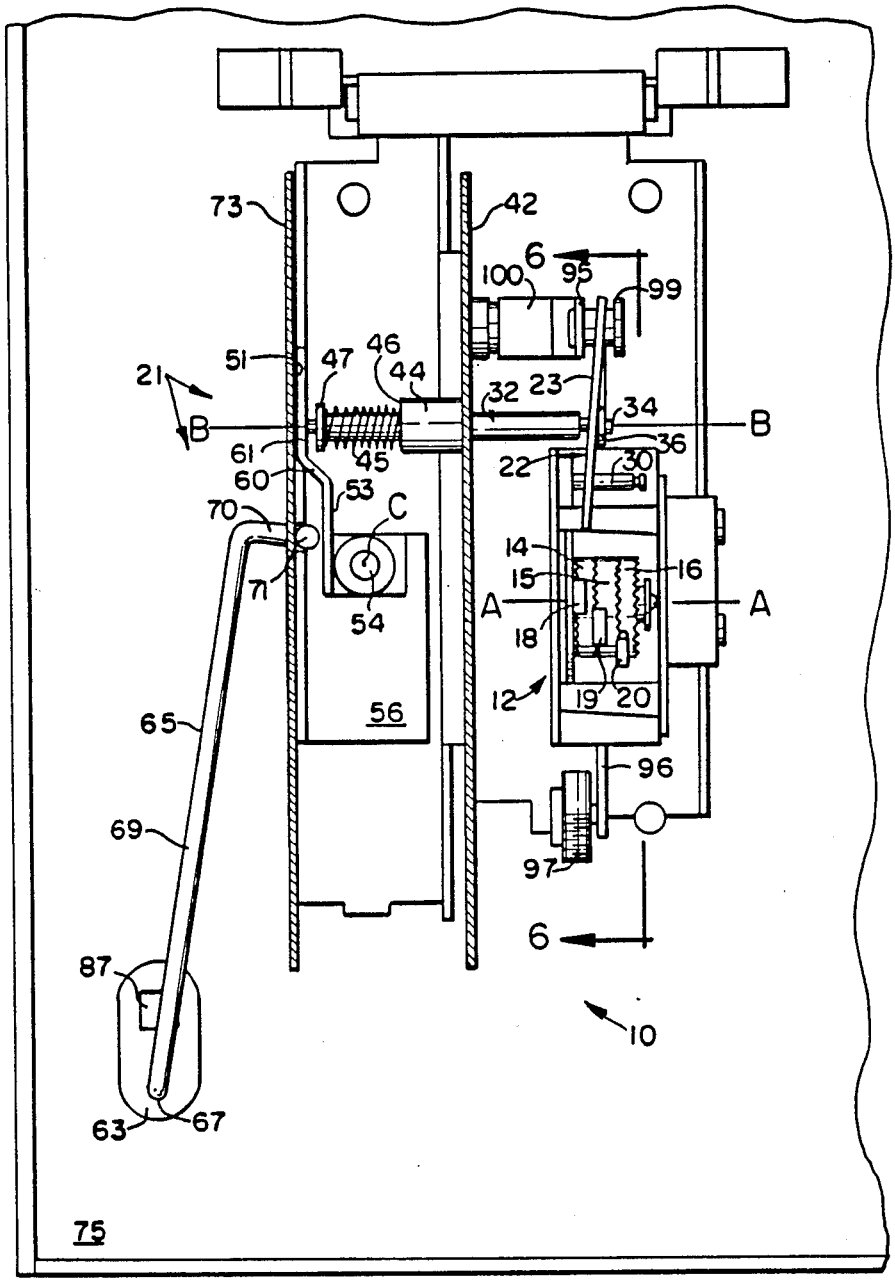
FIG. 3 is an elevational view partially in section of a vending control mechanism of a vending machine in accordance with the invention.

Referring now to the drawings wherein like reference numerals refer to the same or similar elements across the several views, and in particular to FIGS. 1 and 2, vending machine 11 is coin operated and has a vending door 13 carrying a latch 13A. The door 13 can be opened when, as is well known, the required amount has been inserted into the vending machine. Referring now to FIG. 3, there is shown a vending control mechanism 10 according to the invention. The vending control mechanism 10 includes a totalizer 12 having three circular cams 14, 15 and 16. The circular cams 14, 15 and 16 each include a cam projection 18, 19 and 20 respectively. The totalizer 12 is constructed and operates like the coin totalizer disclosed in U.S. patent application Ser. No. 838,526 which is incorporated by reference herein. There is, however, an important difference between the vending machine and totalizer shown in said Ser. No. 838,526 application and that to be described and claimed herein, namely, the vender and its mechanism of the present application contains at least three circular cams as well as a lock means and linking means which functions so that the lock means controls which of the set prices will be effective as will be more fully disclosed hereinbelow.

Figure 4:
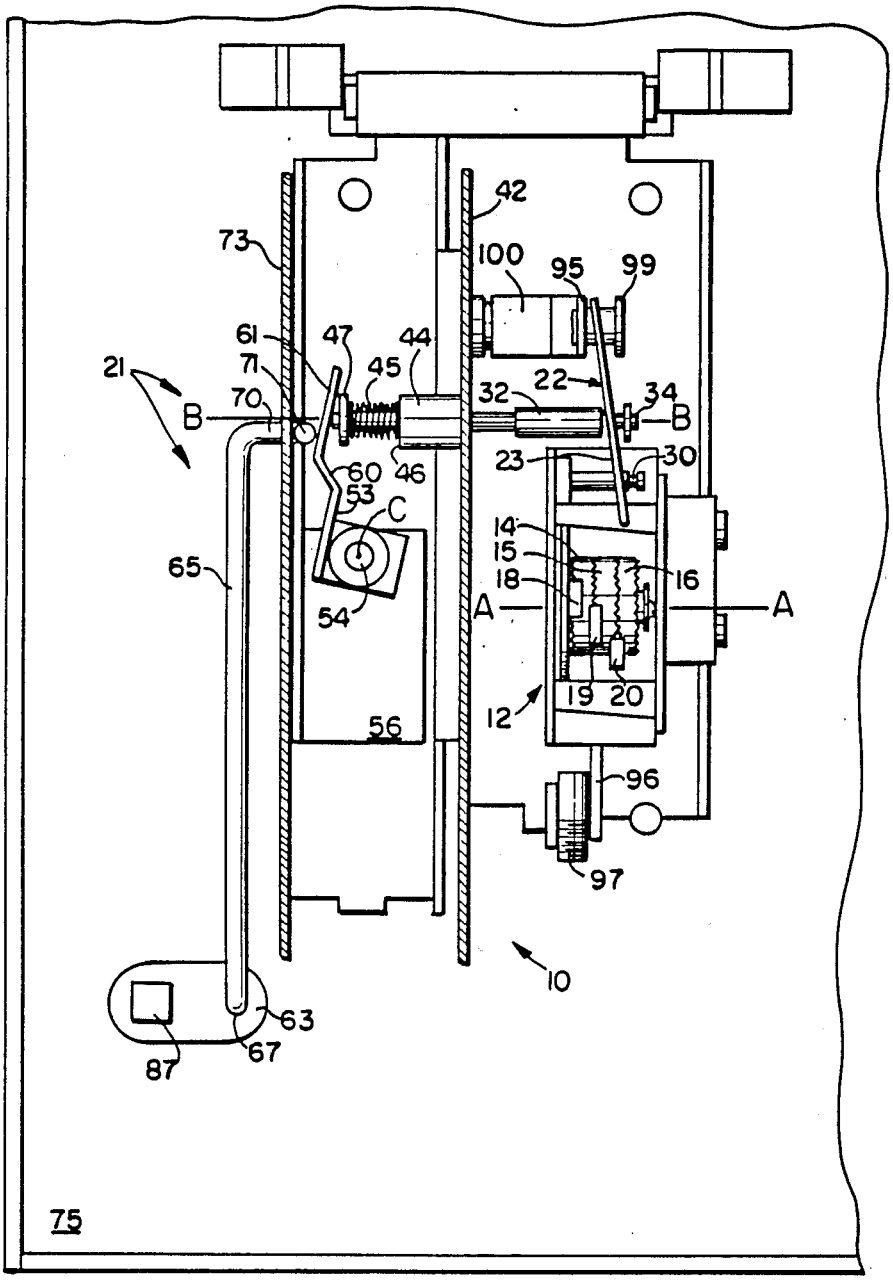
FIG. 4 is an elevational view partially in section of the vending control mechanism of FIG. 3 with the price setting mechanism in a second or high price position.
Figure 5:
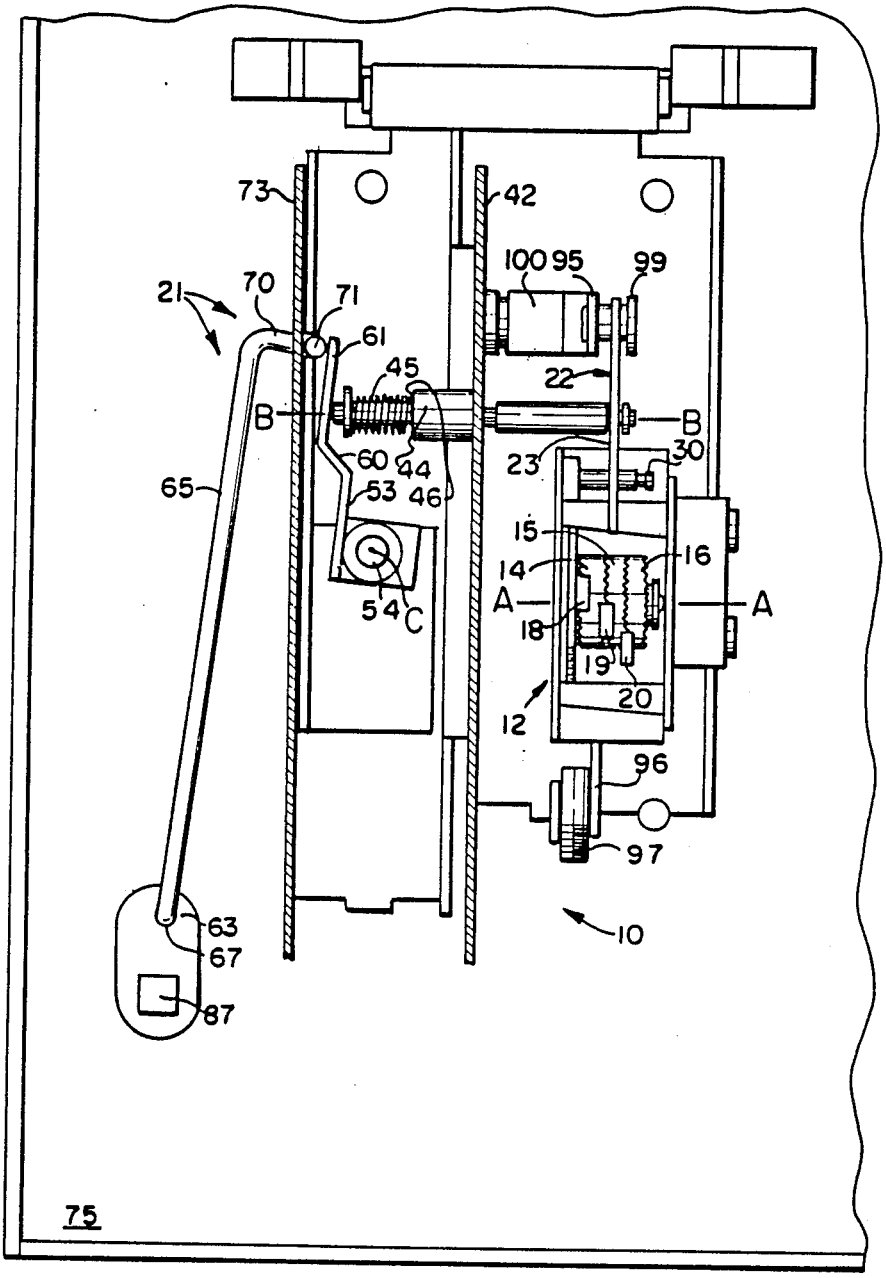
FIG. 5 is an elevational view partially in section of the vending control mechanism of FIG. 3 showing the price setting mechanism a third or intermediate price position.

FIGS. 3, 4 and 5 in addition to totalizer 12 also show the linking means 21 extending between an externally accessible lock means (yet to be described herein), totalizer 12 and door latch 13A. The figures show that part of the vending control mechanism 10 the operation of which requires the correct amount of coins to be deposited into the vending machine. The circular cams 14, 15 and 16 rotate about the axis A—A in angular increments corresponding to the amount of coins deposited in the vending machine. The projections 18, 19 and 20 are at preselected different locations angularly displaced about axis A—A from each other. Such different locations correspond to the preselected prices as described in said copending Ser. No. 838,526 application.

A feeler 22 is disposed over the circular cams 14, 15 and 16. The feeler 22 has an elongated portion 23. The feeler 22 is formed and positioned for movement toward and away from the circular cams 14, 15 and 16.

Figure 6:
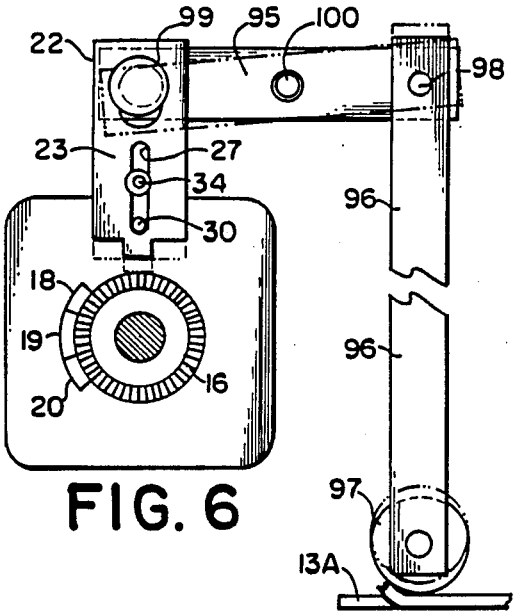
FIG. 6 is an elevational view of the vending control mechanism as viewed along line 6—6 of FIG. 3.

As shown in FIG. 6 and as described in said Ser. No. 838,526 application, the feeler 22 is connected to the vending door latch 13A through a lever 95 which in turn is connected adjacent one end thereof to actuator lever 96 carrying a roller 97. The roller 97 releases the vending door latch 13A when the selected preset price has been satisfied by the required coin deposit. The actuator lever 96 is operatively connected adjacent its upper end to the lever 95 by means of a movable pivot 98. Lever 95 is connected on the far side of a fixed pivot 100 to the upper end portion of feeler 22 by means of a second movable pivot 99, the fixed pivot 100 being located between the two movable pivots 98 and 99.

The feeler 22 is formed with a pivot slot 26 and an elongated narrow slot 27. The pivot slot 26 is formed to permit feeler 22 to pivot in a direction parallel to the plane of the drawing and to axis A—A (FIG. 3). A fixed guide pin 30 extending in the slot 27 insures vertical alignment of feeler 22 as it moves up and down.

When the correct amount of coins corresponding to a selected price has been deposited, the corresponding one of the cam projections 18, 19 or 20 will directly underlie feeler 22. In such position, feeler 22 is prevented from downward movement and the actuator lever 96 cannot move upward and the vending door can be opened.

As shown in FIGS. 3–5, means are provided for aligning the feeler 22 with one of the three circular cams 14, 15 or 16. To this end, a plunger 32 having a longitudinal axis B—B, is movably supported on a guide bearing 44 which is in turn mounted in an opening formed in a first wall 42. Plunger 32 is supported so that its reduced diameter end portion 34 extends in and is slidably retained in slot 27 of feeler 22. A spring 45 is mounted coaxially on plunger 32 and has a diameter greater than the inner diameter of the guide bearing 44. The spring 45 is retained between the end 46 of guide bearing 44 and a retainer clip 47 on plunger 32 against which the left end of spring 45 (as viewed in FIG. 3) abuts.

The left end of plunger 32 abuts a bearing surface 51 located near the upper end of a price selector lever 53. Price selector lever 53 is mounted for movement about pivot 54 which is fixed to an L-shaped bracket 56 mounted on a second wall 73. Pivot 54 has a pivot axis C which is perpendicular to the plane containing axis B—B of plunger 32.

Figure 8:
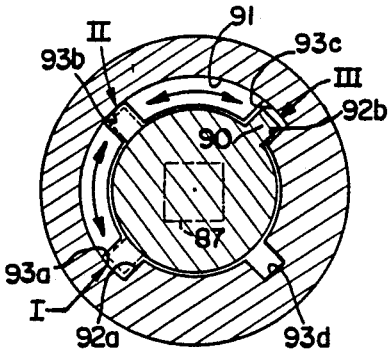
FIG. 8 is a cross sectional view of the lock mechanism when fully assembled and viewed along line 8—8 of FIG. 7.
Figure 7:
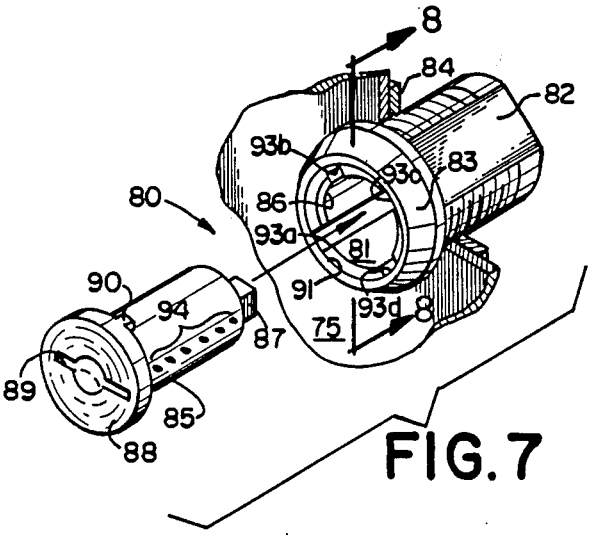
FIG. 7 is an exploded view of a lock for operating the price selecting mechanism of FIGS. 3–5.

A drive crank 63 is mounted on a drive lug 87 rotatable by price selector lock means 80 (shown in FIGS. 7 and 8). The drive crank 63 is movable to any one of three different positions, corresponding to three different prices, by the price selector lock means 80. FIG. 3 shows the first or lowest price position of drive crank 63, FIG. 4 shows the second or highest price position of drive crank 63, and FIG. 5 shows the third or intermediate price position of drive crank 63.

The price selecting lock means 80 is mounted on a front wall 75 of the vending machine as shown in FIG. 7. The price selecting lock means 80 includes a barrel 82 having a collar 83. The barrel 82 is mounted in an opening in wall 75 and retained there by means of a lock nut 84. Elongated slots 93*a*, 93*b*, 93*c* and 93*d* are formed longitudinally along the interior wall 81 of barrel 82. The slots 93*a*, 93*b*, 93*c* and 93*d* are parallel to each other but positioned at different angles about the interior wall 81 of barrel 82. The angles are predetermined to correspond to the lock positions. In the embodiment shown in FIG. 8 the slots are about 90 degrees apart.

A lock cylinder 85 fits into a central bore 86 defined by interior wall 81 in the barrel 82. The drive lug 87 projects from one end of cylinder 85 and a face plate 88 having a key slot 89 is disposed at the other end of the cylinder 85. When cylinder 85 is installed in the barrel 82, the drive lug 87 extends from the end of barrel 82 inside the front wall 75 of vending machine 11 while the face plate 88 is presented externally thereof. A stop lug 90 fixed to the barrel 82 fits into an annular race or channel 91 in the end of barrel 82. As shown in FIG. 8, channel 91 is semi-circular and has stops 92*a* and 92*b* near the ends of non-adjacent slots 93*a* and 93*c*, respectively. The stop lug 90 travels between the stops 92*a*, 92*b* as cylinder 85 is rotated. Thus the stops 92*a*, 92*b* determine the limits of rotation of cylinder 85.

Cylinder 85 has retractable means formed to engage with at least one of the slots 93*a*, 93*b*, 93*c* and 93*d* when cylinder 85 is rotated to one of the lock positions. In the embodiment shown in FIG. 7 the retractable means is realized by at least one row of pins 94. The pins 94 retract upon insertion of the proper key into slot 89 thereby permitting the cylinder 85 to be rotated in barrel 82. The pins 94 are formed to extend into one of the slots 93*a*, 93*b*, 93*c* or 93*d* when aligned therewith. The key can then be withdrawn and the cylinder 85 is thus locked in position. It is noted that the key can be withdrawn only when the row of pins 94 is aligned with one of the slots 93*a*, 93*b*, 93*c* or 93*d*. It is contemplated that said retractable means can include more than one row of pins, for example a second row of pins (not shown) can be positioned diametrically opposite from row 94 on cylinder 85.

Referring back to FIG. 3, the drive crank 63 is operatively connected to the price lever 53 by means of a drive link 65. Drive link 65 has a first lateral extension (not shown) which is inserted through opening 67 in the drive crank 63. The drive link 65 has an elongated shank 69 which extends from the first lateral extension to a second lateral extension 70 which is oriented toward the price selector lever 53. The upper lateral extension 70 extends through the second wall 73 and terminates in a portion 71 which is adapted to bear against the price selector lever 53.

Operation of the price setting mechanism can be readily understood by reference to the drawings in connection with the following description. Selection of the vending price is initiated by insertion of the proper key into slot 89 of cylinder 85 in price selecting lock means 80. The key is rotated to rotate cylinder 85 and position the stop lug 90 at the desired one of the three positions, I, II, or III, as shown in FIG. 8. Rotation of the cylinder 85 causes the drive lug 87 to rotate which in turn rotates the drive crank 63 therewith. Rotation of the drive crank 63 causes vertical displacement of the drive link 65 to select the desired preset price at which the vending control mechanism 10 will operate.

FIG. 3 shows the drive crank 63 positioned in such a way that as viewed from the perspective of FIG. 3 it is in its lowest or "6 o'clock" position. In this position the portion 71 of drive link 65 does not operatively contact or engage the price lever 53. In the absence of any angular displacement of the price lever 53 about pivot 54, the plunger spring 45 is fully extended, thereby retracting the plunger 32. The plunger 32 being in its left most position, the feeler 22 is correspondingly positioned so that its elongated portion 23 is aligned with circular cam 14 corresponding to a first or lowest price.

FIG. 4 shows the drive crank 63 positioned in such a way that as viewed in FIG. 4 the drive crank 63 is in a first extension (not shown) which is inserted through opening 67 in the drive crank 63. The drive link 65 has an elongated shathe inclined portion 60. Price lever 53 is thus rotated an angular distance sufficient to displace the plunger 32 to the right (as viewed in FIG. 4) a first predetermined distance along axis B—B. Plunger 32 when so shifted causes the elongated portion 23 of feeler 22 to align with circular cam 16 which corresponds to the second or highest price that was preset.

FIG. 5 shows the drive crank 63 in the "12 o'clock" position as viewed in FIG. 5. In this position the bent portion 71 of drive link 65 engages the price lever at a position near the upper end of vertical extension 61 of price lever 53. The plunger 32 is thereby displaced a second predetermined distance along axis B—B sufficient to align the elongated portion 23 of feeler 22 over the circular cam 15 which corresponds to a third or intermediate preset price.

Figure 3A:
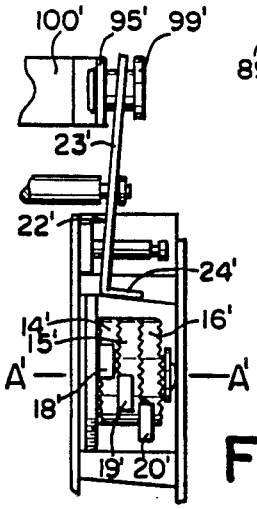
FIG. 3A shows a further embodiment of the feeler 22 shown in FIG. 3.

It is a particular feature and advantage of the present invention that at least three different prices can be set. Furthermore, even if the required changeover from a lower price to a higher price is neglected to be made, the mechanism is configured to still deliver a vend at the higher price. To this end, feeler 22' in a further embodiment shown in FIG. 3A has a lateral extension 24' which, regardless of the position of the elongated portion 23' of feeler 22', overlies any price cam to the right of the cam corresponding to the set price. For example, in FIG. 3A the lateral extension 24' of feeler 22' overlies the cams 15' and 16' corresponding to the intermediate and high prices. It can be seen, therefore, that the feeler 22' could contact any one of the cam projections 18', 19', 20' and thus the vending door latch 13A would be released upon coinage amounting to any one of the preset prices. It can be readily appreciated from FIG. 3A that with feeler 22' in the intermediate price position the lateral extension 24' would overlie price cam 16', corresponding to the high price. Accordingly, the feeler 22' would contact either price cam projection 19' or 20', thus permitting release of the vending door latch upon deposit of coinage amounting to either the intermediate or the high price. Thus, a customer inserting an amount corresponding to the true price of the article to be vended would not be denied a vend, although it is true that the mechanism would still operate at the lower price.

It will be recognized by those skilled in the art that changes or modifications may be made to the above-described embodiment without departing from the broad inventive concepts of the invention. It is understood, therefore, that the invention is not limited to the particular embodiment which is disclosed, but is intended to cover all modifications and changes which are within the scope and spirit of the invention as defined in the claims which follow.

What is claimed is:

1. A vending machine having a vending door controlled by a latch in response to the insertion of coins totaling to a preset price, comprising:

totalizer means including price setting means for setting at least three independently selectable prices and for totalling the inserted coins;

latch actuating means responsive to the totalizer means for permitting opening of said door when coins have been inserted equal in value at least to a predetermined one of said prices;

said vending machine having an opening formed therein;

lock means including a lock cylinder mounted for rotation to each of at least three lock positions by a key inserted in said opening and selectively moveable thereby among said at least three lock positions which said at least three lock positions correspond respectively to each of said prices; and means linking said lock means and said latch actuating means so that said predetermined price corresponds to the selected one of said lock positions, said linking means including feeler means responsive to said price setting means, plunger means for positioning said feeler means relative to said price setting means, and plunger actuating means operatively connected between said feeler means and said lock means.

2. In a vending machine of the type having a vending door latch which is released in response to the insertion of coins totaling to a preset price, apparatus for setting the price at which an article is to be vended, comprising:

totalizer means for totaling the values of coins inserted in the vending machine, said totalizer means including three cams which are movable from a starting position to a predetermined position upon completion of the insertion of coins totaling to the set price, each of said cams having a cam projection;

feeler means for engaging a cam projection when one of the cams is in its predetermined position, said feeler means having an end operatively connected to the vending door latch;

plunger means operatively connected at one end said feeler means for aligning said feeler means with one of said three cams; and plunger displacing means operatively connected to the other end of said plunger means for displacing said plunger to position said feeler in a first position corresponding to a first preset price, in a second position corresponding to a second preset price, or in a third position corresponding to a third preset price.

3. Price setting apparatus as recited in claim 2 wherein said plunger means has a longitudinal axis and said plunger displacement means comprises:

a lever formed to pivot about a pivot axis perpendicular to a plane containing the longitudinal axis of said plunger means such that said lever, when operated, pivots in said plane, said lever extending from said pivot axis to said other end of said plunger means whereby, when said lever pivots in said plane, it displaces said plunger means along said longitudinal axis.

4. Price setting apparatus as recited in claim 3 said plunger displacing means further comprises:

rotatable means operatively connected to said lever for pivoting said lever about said pivot axis such that it displaces said plunger means.

5. Price setting apparatus as recited in claim 4, wherein said plunger displacing means comprises:

an elongated link operatively connected between said rotatable means and said lever.

6. Price setting apparatus as recited in claim 4 wherein said rotatable means comprises:

lock means having three stop positions and accessible from the exterior of the vending machine for remotely activating said rotatable means; and a drive crank operatively connected to said lockable means.

7. Price setting apparatus as recited in claim 6 wherein said lock means comprises:

a lock barrel mounted in an opening in an external wall of the vending machine; and a lock cylinder disposed in said lock barrel and formed to receive a key whereby said lock cylinder can be rotated to one of said three stop positions corresponding to the desired vending price.

8. Apparatus as recited in claim 2 wherein said feeler means comprises an elongated portion which engages with the cam corresponding to the set price and a lateral extension which engages with one of the other cams corresponding to a higher price when said one of the other cams is in its predetermined position.

9. Apparatus as recited in claim 2 wherein said three cams are disposed for rotation about a common axis such that they can rotate about said axis from the starting position to the predetermined position.

10. Apparatus as recited in claim 9 wherein the cam projections are at preselected different locations angularly displaced about the common axis.

11. Apparatus as recited in claim 2 wherein said plunger means comprises a spring for retracting said plunger from said second or third positions to said first position.

* * * * *

UNITED STATES PATENT AND TRADEMARK OFFICE

CERTIFICATE OF CORRECTION

PATENT NO. : 4,844,229

DATED : July 4, 1989

INVENTOR(S) : EVELYN FRIEDMAN and WILLIAM R. CARSWELL

It is certified that error appears in the above-identified patent and that said Letters Patent is hereby corrected as shown below:

Column 5,

Lines 19-22, "a first extension (not shown) which is inserted through opening 67 in the drive crank 63. The drive link 65 has an elongated shathe", should read --its middle or "3 o'clock" position. In this position, the portion 71 of drive link 65 engages the price lever 53 at a position just above the--.

Signed and Sealed this

Twenty-ninth Day of May, 1990

*Attest:*

HARRY F. MANBECK, JR.

*Attesting Officer*

*Commissioner of Patents and Trademarks*